US005778815A

United States Patent [19]

Shields et al.

[11] Patent Number: 5,778,815

[45] Date of Patent: Jul. 14, 1998

[54] SHIP HATCH COVER

[75] Inventors: Glen E. Shields, North Vancouver; Barry D. Jones, Saskatoon, both of Canada

[73] Assignee: Canpotex Shipping Services Limited, West Vancouver, Canada

[21] Appl. No.: 803,698

[22] Filed: Feb. 21, 1997

[51] Int. Cl.[6] ..... B63B 19/12

[52] U.S. Cl. ..... 114/201 R

[58] Field of Search ..... 114/201 R, 202, 114/203; 414/137.4

[56] References Cited

U.S. PATENT DOCUMENTS

| | | | |
|---|---|---|---|
| 524,137 | 8/1894 | Enright . | |
| 2,844,117 | 7/1958 | MacGregor et al. | 114/202 |
| 3,312,990 | 4/1967 | Lapworth | 9/1 |
| 3,405,814 | 10/1968 | Yanow | 114/201 R |
| 3,800,723 | 4/1974 | Collins | 114/201 R |
| 4,130,125 | 12/1978 | Nivin | 135/6 |
| 4,237,809 | 12/1980 | Hickmann | 114/202 |
| 4,300,440 | 11/1981 | Holter | 114/201 R |
| 4,393,888 | 7/1983 | Nivin | 114/201 R |
| 4,941,422 | 7/1990 | Muller | 114/203 |
| 5,322,405 | 6/1994 | Swensson et al. | 114/201 R |

FOREIGN PATENT DOCUMENTS

| | | | |
|---|---|---|---|
| 962735 | 6/1950 | France | 114/202 |
| 1344413 | 10/1963 | France . | |

*Primary Examiner*—Stephen Avila
*Attorney, Agent, or Firm*—Chapman and Cutler

[57] ABSTRACT

A ship hatch cover of lightweight, water impervious sheet material covers the hatch of a ship to permit loading of bulk materials during inclement weather while protecting the cargo from potential damage or spoiling from rainwater or other contaminants. The hatch cover includes a frame or superstructure for spanning the open portion of a ship's hatch. A lightweight, flexible, water impervious sheet material is stretched over the frame to prevent any moisture or other contaminants from entering the ship's hold while the ship cover is in place. A plurality of separately accessible ports or openings permit even distribution of a particulate or fluent cargo, such as potash or agricultural products.

6 Claims, 7 Drawing Sheets

FIG. 8
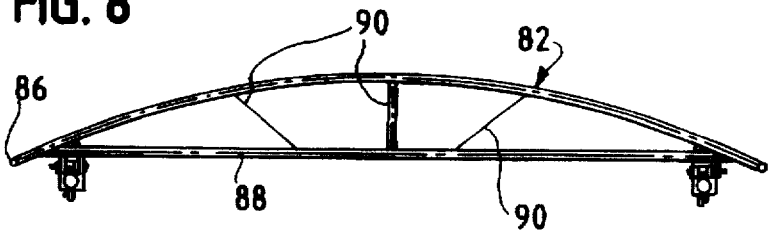
FIG. 9
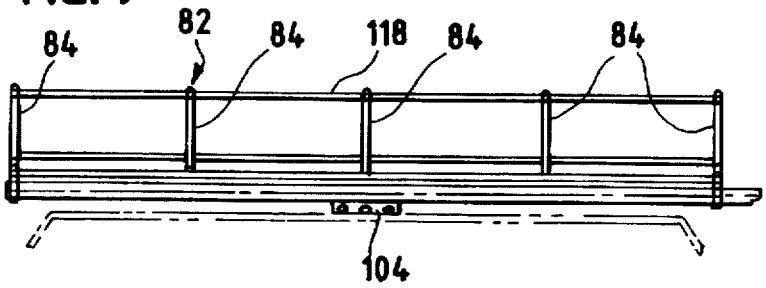
FIG. 11
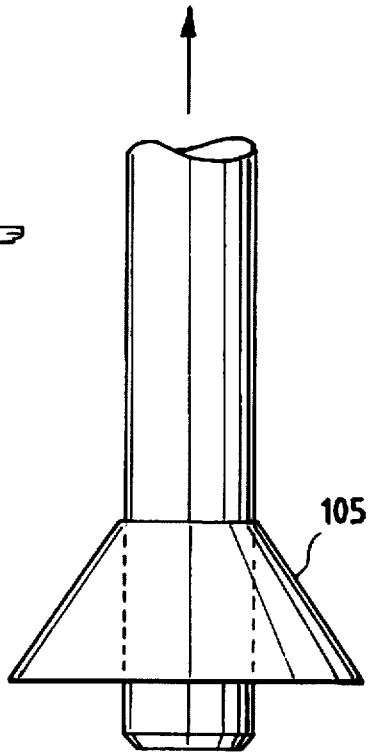
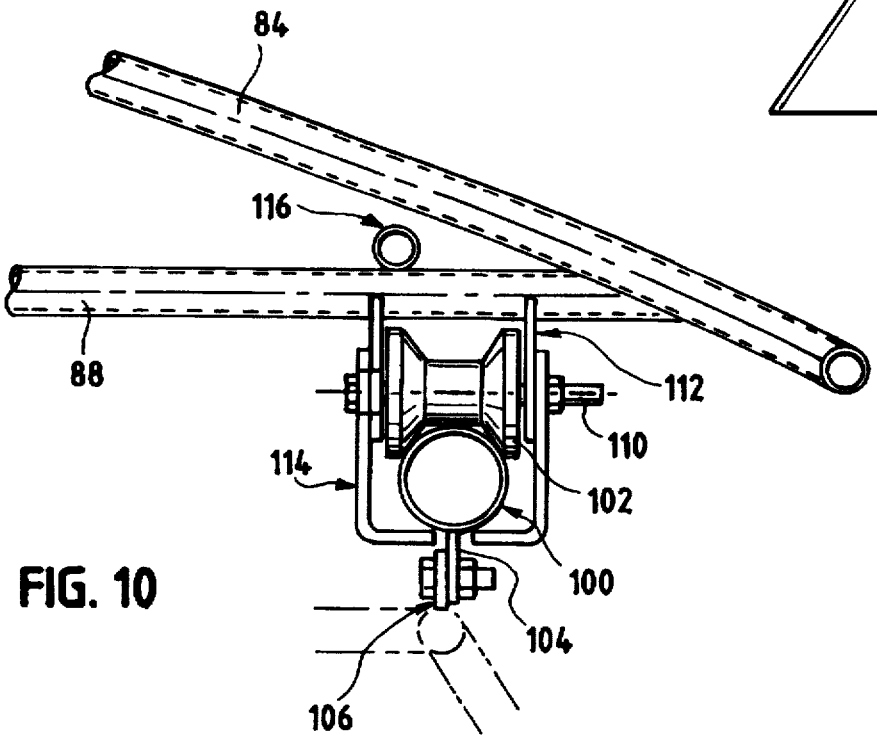
FIG. 10

SHIP HATCH COVER

BACKGROUND OF THE INVENTION

The present invention concerns a method and a device for permitting the handling or loading of cargo aboard a ship during inclement weather and, in particular, to an all-weather, portable hatch cover which permits the loading of bulk, particulate or fluent cargo, into the hold of a ship, for example, while it is raining, while protecting the cargo from damage that could be caused by moisture or other contaminants.

FIELD OF THE INVENTION

The invention relates to devices for shielding cargo by protecting the hatch opening of a ship from precipitation or other contamination during cargo loading.

If perishable goods, such as agricultural products, potash, or similar goods, are to be transported by ship or barge, foul or inclement weather can substantially delay or inhibit the loading of the cargo onto the barge or ship resulting in increased costs. Modern day ocean-going ships that are used to transport unpackaged or bulk particulate or fluent cargo, such as alfalfa pellets, agricultural products, minerals, salt, potash and other fertilizers, and other types of goods, are generally constructed with at least one large hatch or opening in the deck of the ship that permits access to the hold below. Typically, the hatch is closed by a hatch cover in which the hatch covers, when closed, shield the hold and prevent any water or contaminants from entering or mixing with the cargo. The hatch covers typically are sized to fit and sealingly close the open end of the hatch and may be opened for loading or unloading purposes. A typical hatch will include two or more portions or sections in which the outermost two sections are generally hinged for pivotal upward movement at the ends of the hatch that are normally perpendicular to the longitudinal length of the ship. Intersections of the hatch covers are pivotally connected or hinged to adjacent section edges so as to fold against one another when the hatch is opened for loading or unloading.

When the hatch cover is either partially or totally opened for loading, a substantially large area or opening to the hatch is exposed. The size of this hatch opening can range anywhere from approximately 250 to 550 square meters.

In normal loading operations, during good weather, a conveyorized boom is lowered into the opening and the cargo is dispensed. The boom is moved around slightly during the loading operation to insure that the particulate or fluent material is spread out sufficiently within the hold of the ship. However, many bulk products, such as agricultural grains and processed materials, such as potash and salt, can be severely damaged if they are exposed to rain or other sources of water and, therefore, loading these types of products onto ships must often be delayed until the weather conditions change. This is not only a major inconvenience, but it is also very uneconomical, and often prohibitive to require a ship to wait for improved weather before loading can proceed. Therefore, there is a desire and a need for a system or device that can be used to permit loading of this type of cargo during inclement weather.

Large covers of the type shown in U.S. Pat. No. 4,237,809 have been proposed for permanent installation and are typically movable for loading or unloading cargo, but provide no protection during inclement weather. U.S. Pat. No. 4,130,125 discloses a lightweight hatch cover and provides a substantial degree of ventilation, but no protection for loading cargo during inclement weather. Similarly, U.S. Pat. No. 2,844,117 discloses a device to protect the hatch opening during bad weather conditions. However, this device includes a plurality of metal sections and other elements to make it collapsible, but would be relatively expensive to manufacture and cumbersome in use. By contrast, the all-weather loading portable hatch cover of the present invention has a simplified construction and other improvements as will be recognized with respect to the following description.

Other types of hatch covers have been disclosed, for example, in U.S. Pat. Nos. 524,137; 3,312,990; 4,130,125; 4,393,888; 4,237,809; and 4,941,422.

SUMMARY OF THE INVENTION

Accordingly, it is a general object of this invention to protect the hatch opening of a vessel, such as a ship or barge, from precipitation during cargo loading.

Another object of the invention is to provide a device to eliminate precipitation and other contaminants from entering the hold of a ship during the loading process.

Another object of the invention is to provide an economical, relatively lightweight hatch cover to be used for loading cargo during inclement weather.

Another object of the present invention is to provide a ship hatch cover which permits loading of perishable cargo into ships which have variable size hatch openings.

Yet another object of the present invention is to provide a hatch cover of this general type that includes a plurality of openings or a movable opening so that particulate or fluent materials can be evenly loaded within the hold of a ship.

Another object of the present invention is to provide a method for loading cargo onto a ship during inclement weather while precluding contamination of the cargo with foreign material, such as precipitation, dust, and the like.

Other objects, features and advantages of the present invention will be found throughout the following description and the accompanying drawings.

BRIEF DESCRIPTION OF THE INVENTION

The present invention provides a hatch cover for a vessel, such as a ship or a barge, which includes a covering of water impervious material to prevent precipitation, or the like, from entering the hold of a ship or barge while it is being loaded with cargo during inclement weather. The hatch cover includes a main central portion which spans the hatch from side to side and which is covered with a lightweight, impervious material. A pair of pivotally attached extensions or wings on each of the longitudinal sides of the hatch cover insure complete coverage of the hatch opening, which vary in size from ship to ship. A plurality of separately openable, circular openings or ports are provided in the hatch cover and are each selectively openable so that the cargo can be loaded through various openings to provide more even loading of the cargo within the hold of the ship.

BRIEF DESCRIPTION OF THE DRAWINGS

FIG. 8 is a front elevational view of one of the port cover elements of the present invention;

FIG. 9 is a side elevational view of the port cover element of FIG. 8;

FIG. 10 is an enlarged view of the roller mounting mechanism for the port cover shown in FIG. 8;

FIG. 11 shows the port hood which is mounted on the filling spout of the boom to prevent rainwater from entering through the port in the hatch cover during loading;

DETAILED DESCRIPTION OF THE PREFERRED EMBODIMENT

Figure 1:
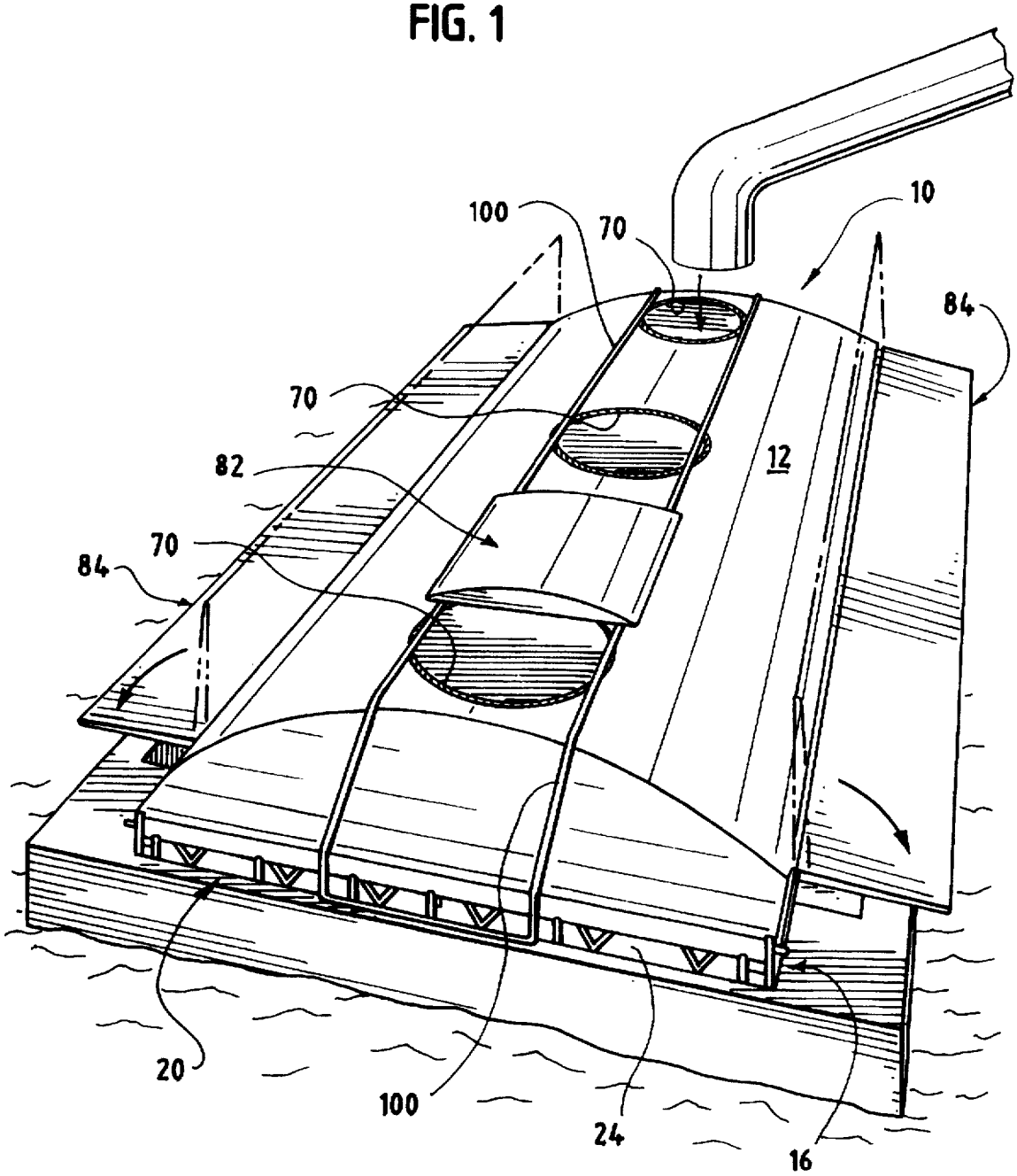
FIG. 1 is a perspective view of the all-weather loading portable hatch cover made in accordance with the present invention.
Figure 2:
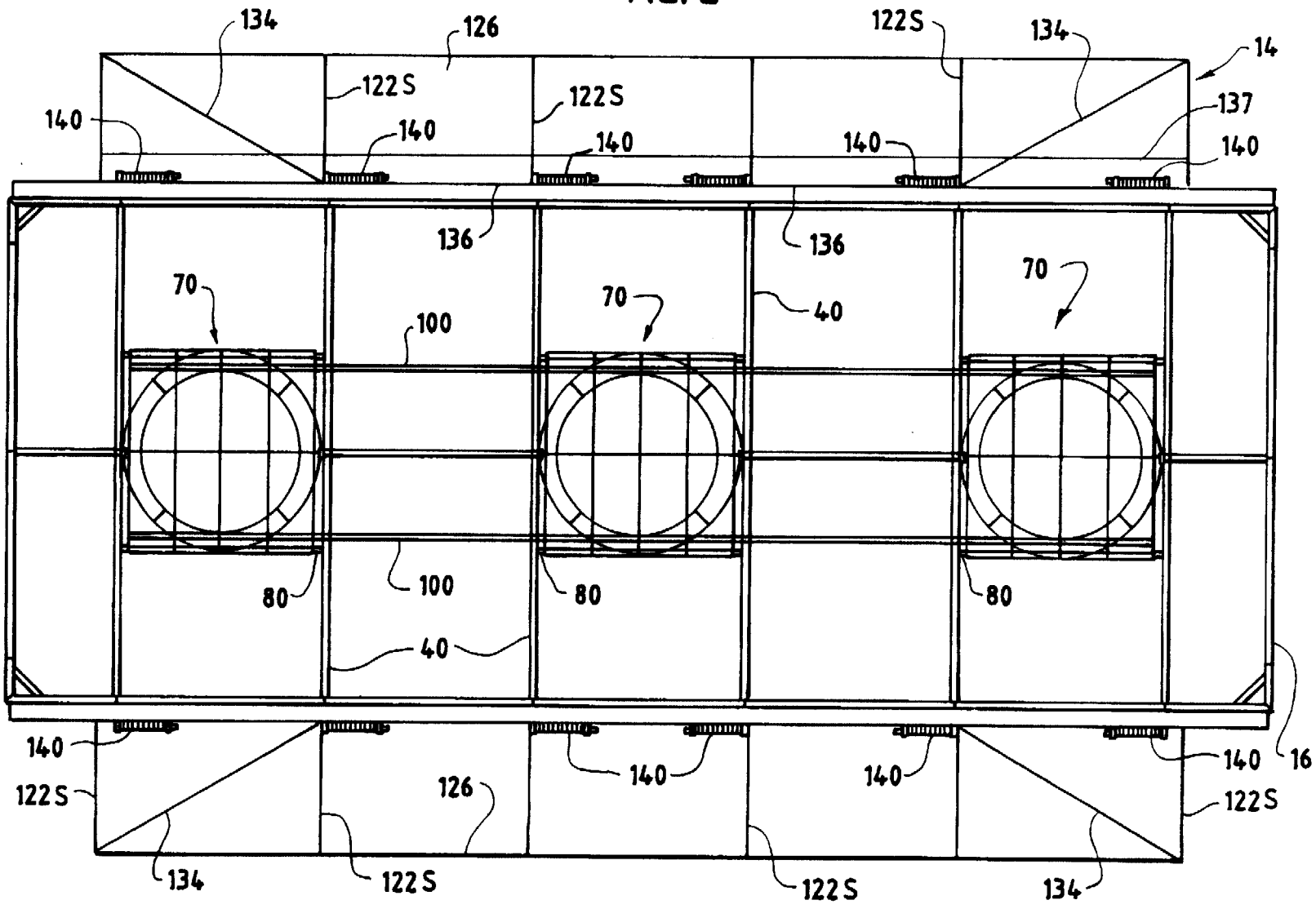
FIG. 2 is a top plan view of the ship hatch cover made in accordance with the concepts of the present invention with the cover sheeting removed.

Referring to FIGS. 1 and 2, the all-weather loading portable hatch cover of the present invention, generally designated 10, is shown in two conditions. FIG. 1 shows the hatch cover with a water impervious, sheet material 12 secured to the frame of the hatch cover 10 as will be described in greater detail hereinafter. The sheet covering can be made of any suitable material, such as reinforced plastic, canvas or other material, that is tough, durable and impervious to water. Preferably, however, the cover 12 is extremely tough and tear-resistant and non-stretching, so that it can be stretched taut over the frame and will not sag at points where it is not directly supported.

For clarity, and clearness of understanding of the invention, the portable hatch cover, as shown in FIGS. 2 through 6 and FIGS. 8 through 12, are shown in the assembled condition, but with the cover 12 removed to expose the super-structure or main frame, generally designated 14. In the preferred embodiment, the frame 14 is made of tubular steel and plate steel elements that have been coated with a corrosion-resistant material such as that sold under the name Zinga.

Figure 3:
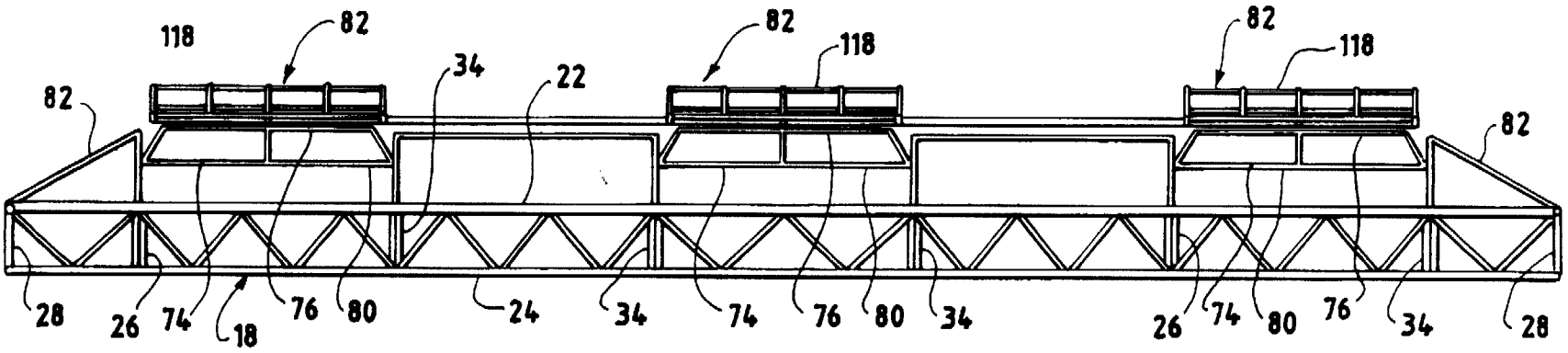
FIG. 3 is a side elevational view of the ship hatch cover of FIG. 2.
Figure 4:
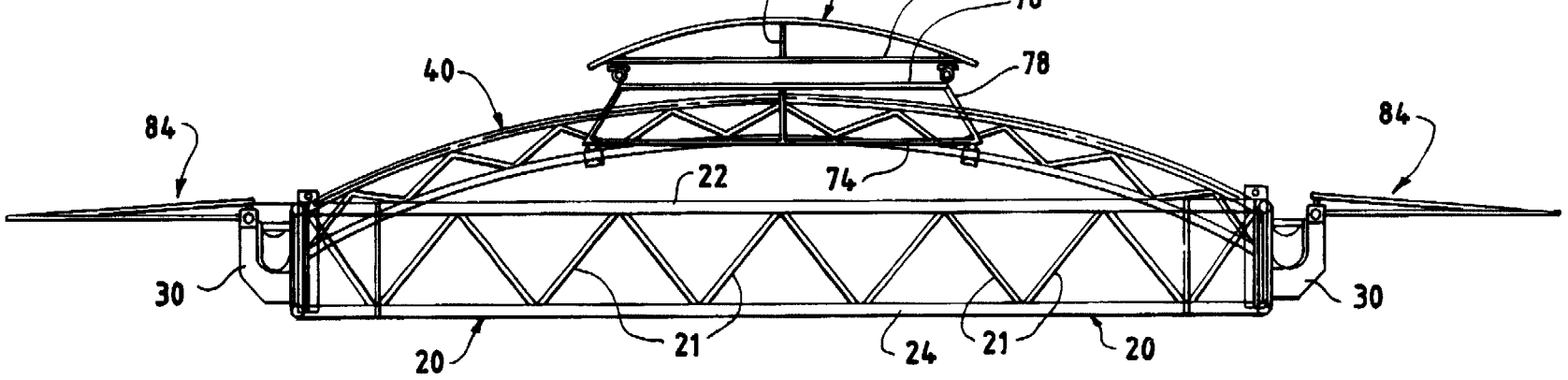
FIG. 4 is an end elevational view of the ship hatch cover of the present invention.
Figure 6:
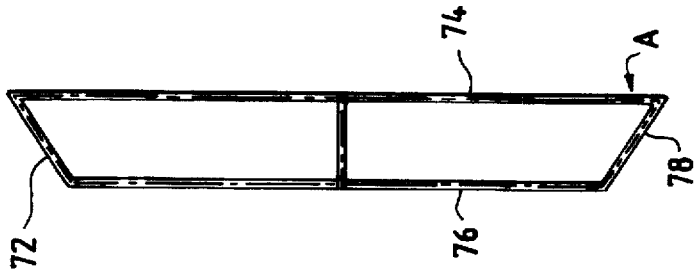
FIG. 6 is a side elevational view of the port structure of FIG. 5.

Referring again to FIG. 1, the frame 14 includes a generally rectangular lower frame portion 16 manufactured by welding the individual elements together as a single unit. The lower frame 16 is generally rectangular in shape as shown, having two side elements 18 as shown in FIG. 3 and two end elements 20 as shown in FIG. 4. In each case a plurality of rigidifying members or webs 21 of 1 9/16 inch O.D., 14 ga. structural steel tubing welded between top and bottom stringers 22 and 24, respectively, which are 4 inch O.D. 10 ga. structural steel. Also, 6 T shaped vertical members 34 are welded at the locations shown for connecting additional elements as will be described in greater detail hereinafter. In the successfully tested design, the overall size of the lower frame 14 was 60 feet long by 24 feet wide. However, it will be clear to one of ordinary skill in the art that the a hatch cover must be sufficiently rigid and sized according to the size of the ship hatch to be covered. Also, any suitable material, such as aluminum or a desired alloy can be used if desired and the size of the components and the number of bracing members used will vary depending on the strength of the material selected.

It should also be noted that when the portable hatch cover is being used, the inclement weather may also be relatively windy and the large surface area of the cover 20 could tend to act as a sail upon catching a gust of wind. Therefore, it is desirable that the assembled unit be relatively heavy, in addition to being rigid, so that it will resist lifting during a steady wind or moderate gusts of wind. The hatch cover, as described in the preferred embodiment is approximately 10,000 pounds and thus would not be readily moved by a gust of wind. Also, such weight will provide stability and rigidity when a crane is being used to hoist the portable cover onto the open hatch of a ship. Alternatively, other systems could be employed to prevent movement of the portable hatch cover once it is positioned over the hatch opening. For example, mechanical clamps or other attachment means could be provided to interconnect or lock the portable hatch cover over the open hatch. Similarly, a plurality of electromagnets could be provided at spaced positions along the edges of the main frame, such that they would align with iron or steel elements on the hatch or deck of a ship. Once the portable hatch cover was moved into position, the electromagnets could be energized from power supplied from the ship or from a remote location on the dock.

Alternatively, the elements of the frame could be made in boltable sections that are approximately 30 feet long and 12 feet wide. Each section could be identical with one another and be manufactured separately and then bolted together as a single unit in this case each section could have a pair of vertical plates at the location 26 at their ends which bolt to the end plate of the adjacent frame section and sandwich therebetween the generally outwardly extending wing mounting arm or flange described below.

In the preferred embodiment, the entire 60 foot length is formed as an integral piece with the 28 diagonal strengthening webs or ribs welded as shown at about 60° between the upper and lower stringers 22 and 24. Each of the stringers is preferably made of 4" diameter steel tubing and the ends are closed by a vertical pair of similar tubing sections 28, approximately 3 feet long.

Figure 12:
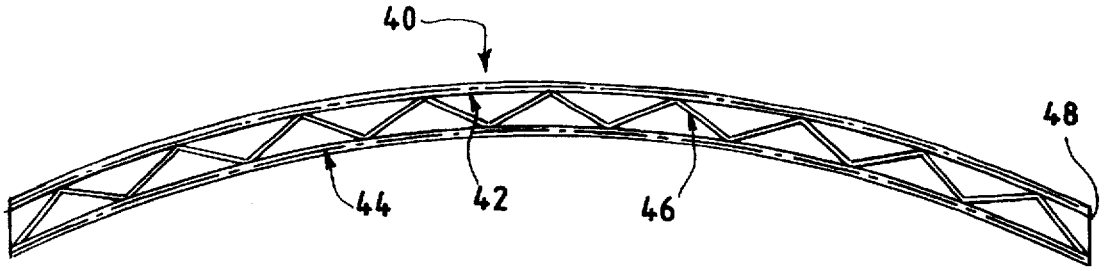
FIG. 12 is a side elevation of the arch truss member of the present invention.
Figure 13:
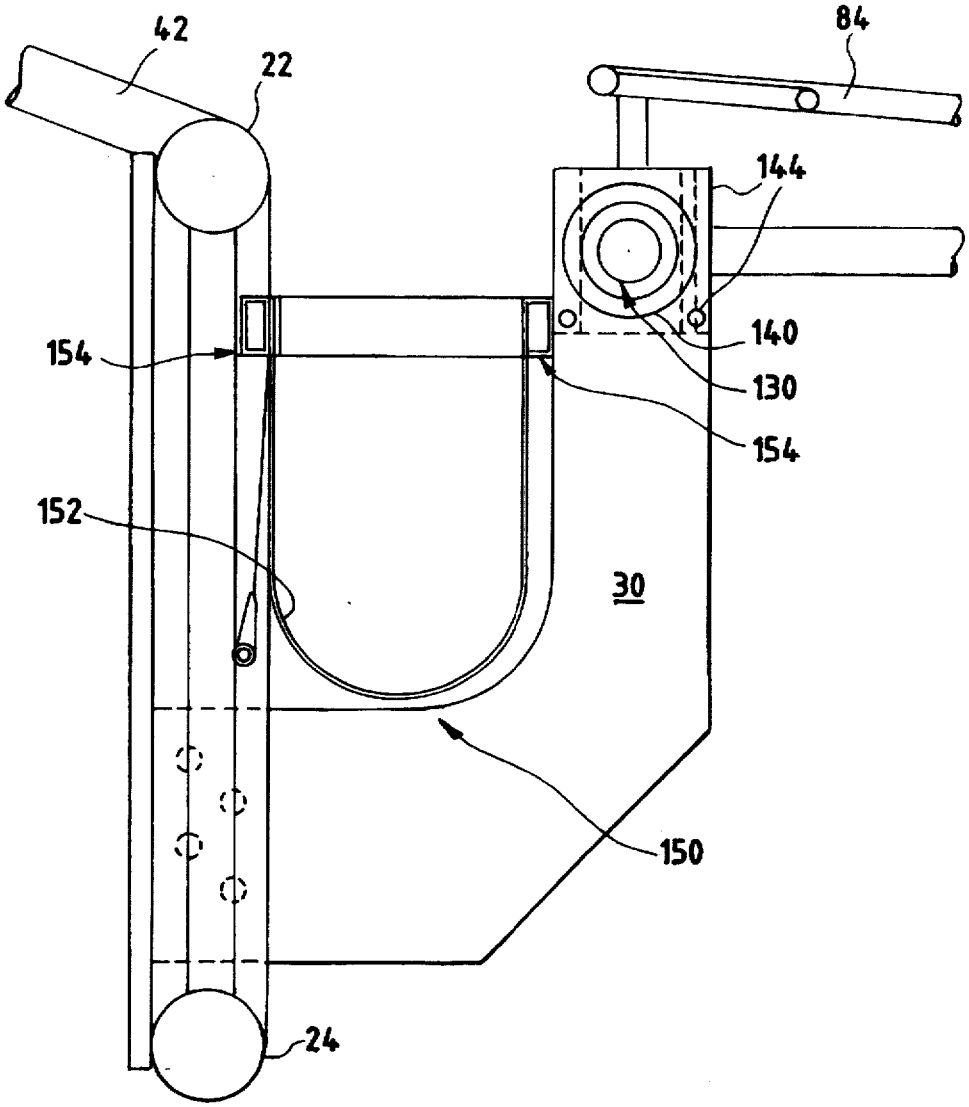
FIG. 13 is an enlarged elevational view of the wing mounting bracket of the present invention.
Figure 15:
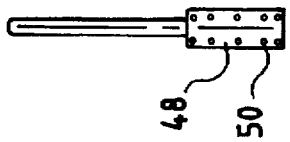
FIG. 15 is a side elevational view of the arch truss shown in FIG. 10.

The six vertical flange connecting elements 34 are also welded at the increment shown for supporting a wing bracket 30 and the arch truss 40 shown in FIG. 12. The arch truss 40 includes an upper arch member 42 and a lower arch member 44. The arch members 42 and 44 are again interconnected with a plurality of welded strengthening ribs 46 which are welded in the arrangement as shown. The upper and lower arch members 42 and 44 are made of 14 gauge 2⅜" structural tubing while the strengthening ribs 46 are made of 1" diameter 14 gauge structural tubing. A pair of end plates 48 are welded to the ends of the arch members 44 and 42 and, as shown in FIG. 15, include a plurality of bolt holes or apertures 50.

Each side section 18 is spaced apart by and connected to the end sections 20, as shown in FIG. 4, which is similarly constructed of upper and lower stringers, 22 and 24, and diagonal strengthening or rigidifying web members 21. The end sections 20 and the side members 18 are preferably welded at their junctions, sharing the vertical members 28 which serve as corner posts, to provide a very rigid, rectangular frame.

The arch trusses 40 have their end plates 48 mounted to the inside surface of the respective vertical members 34 to provide the generally rectangular frame 14 having five arch trusses 40 connected from side to side in a generally parallel arrangement.

Figure 5:
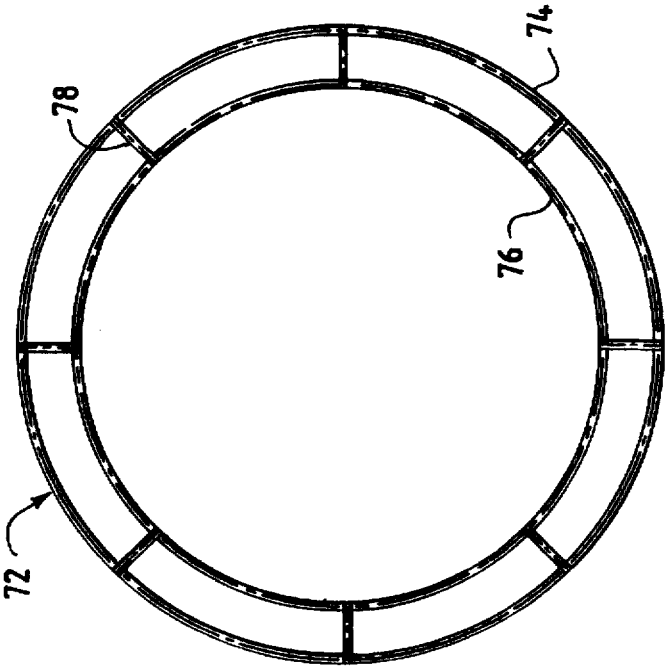
FIG. 5 is an enlarged plan view of the port structure made in accordance with the present invention.

A plurality of apertures or ports, generally designated 70, are provided at the top or uppermost point between the arch trusses 40, and are used for filling or loading the ship as will be described in greater detail hereinafter. In the embodiment, as shown, three structures 72 are provided for three apertures or ports 70. Referring in particular to FIG. 5, each port structure 72 includes a large circular element or ring 74 and an inner circular ring 76 which are connected by eight rib elements 78 as shown. The included angle between the lower ring 74 and the rib 78, designated A in FIG. 6 of the preferred embodiment is 58°, although the inventors are aware of the fact that this angle can be substantially varied. The circular port assemblies are sized so that the larger ring 74 spans the distance between adjacent arch trusses 40 with the lower ring 74 being connected to the lower arch element 44 at its midpoint by a clamp or welding. In the preferred embodiment, an additional pair of horizontal supports 80 are connected between adjacent lower arch truss members 44 to support the outermost edges of each of the ring members 74.

In order to provide a smooth contour at the longitudinal ends of the frame, a plurality of angled risers 82 are supplied to support the cover sheet 12. In one embodiment, once the main frame 14 has been assembled, the impervious cover is stretched over the frame and attached in a conventional manner by straps and tightening ratchets to the lowermost stringers 24 so as to be stretched taut across the entire frame. Three circular apertures are provided in the cover 12 and are substantially the same diameter as the ring elements 76. A plurality of apertures are provided adjacent the edges of the circular openings so that the cover can be lashed to the ring 76 in a conventional fashion.

In addition to the above describer main frame section 14 of the portable hatch cover, the assembled unit includes a plurality of port covers 82, one for each opening 70 and a pair of longitudinal outriggers or wings 84 which add to the flexibility and usefulness of the cover. As described above with respect to the loading of particulate or fluent cargo, it is necessary to move the feed nozzle to various locations within the hatch opening on the ship to insure even filling so that a maximum amount of cargo can be loaded. Therefore, in this embodiment, three ports or apertures 70 are provided for three specific, fixed filling locations. It would also be preferable if a movable or slidable portal or opening were provided, while at the same time, insuring a ring-tight fit. For example, an accordion-type flexible bellows could be provided on either side of the center aperture, for example, and a support system devised for moving the aperture to different locations along the longitudinal axis during use. In the present embodiment of the invention, only one of the openings 70 will be in use at a particular time and, therefore, three ports or apertures 82 are provided for covering the respective apertures 70. In another embodiment contemplated by the present inventors, a single, movable hatch opening may be provided so that it can be positioned at different relative locations along the longitudinal length of the portable hatch cover for even distribution of cargo. In one such system, an overlapping pair of belts could be supported to define a movable slot to permit the loading of cargo at various positions along the length of the portable hatch cover.

Each of the port or aperture covers 82, as shown in FIGS. 8 and 9, includes five generally arcuate parallel ribs 84, each of which is welded to a similar tube 86 at each end. Five horizontal ribs 88 are also connected near the lower ends of the arcuate ribs 84 and one or more vertical or angled stabilizing ribs 90 between the elements 88 and the arcuate 84 are provided for additional rigidity. Preferably, one vertical support 90 and two angled supports 90 shown in FIG. 8, should be used. Typically, all of the tubing elements for the above-described port cover are made of 1" diameter 14 gauge structural tubing which is similarly treated for corrosion resistance. Preferably, at least three additional rigidifying tubing members are provided for each of the port covers 82. As shown in FIG. 10, a longitudinal tube 116 extends parallel to the rail 100 and is welded to each of the transverse members 88 on each side of the cover structure 82. Similarly, a uppermost support member 118 connects the top points of the arcuate ribs 84 to provide an integrally welded frame or structure upon which an impervious cover is lashed tightly as described previously.

Referring to FIG. 10, a movable mounting means is provided for each port or aperture 82 so that it can be moved to provide access to the port or opening beneath. The view shown in FIG. 10 is an enlarged section showing the lower end of one of the port covers 82. Four of these roller supports are typically provided for each port cover for support at each corner. The main frame structure 14 includes two rails 100 which run the entire longitudinal length of the hatch cover 10. The rails 100 are made of 3" diameter tubing for supporting a roller 102 as shown in FIG. 10. Each of the rails 100 include three depending flanges 104 which are bolted to three similar, aligned upwardly extending flanges 106 mounted on the top of the upper ring 76 of the port structure as described previously.

The roller 102 is rotatably mounted by an axle 110 to a pair of depending flanges 112 welded near the end of the respective end elements 88 on each of the three ports or apertures 82. In this manner, the rollers 102 support the four corners of each port cover assembly for sliding movement along the longitudinal direction of the hatch cover 10. Also as shown in FIG. 10, a pair of safety latches 114 are provided and extend downwardly from the axle 110 curving inwardly toward the flange 104 to prevent a gust of wind or other force to inadvertently lift the relatively lightweight port cover off of the rails 100.

In this way, a port cover 82 is provided for each of the ports 70 and it is mounted for sliding movement on the rail and roller assembly described with respect to FIG. 10. During the loading operation, one of the apertures is exposed and the feed nozzle extended therethrough for loading. As can be seen in FIG. 11, the feed nozzle is fitted with a hood 105 in a manner such that the nozzle extends downwardly past the lower edge of the hood 105 and, therefore, can extend into one of the ports 70 for loading. The hood 105 is designed so that it can be mounted at many positions on the feed nozzle so that more or less of the feed nozzle may extend past the bottom of the hood. A truncated, conically shaped flange 105, as shown in FIG. 11 is mounted on the feedloading nozzle to insure that rain or other contaminants do not enter through the hatch by the annular space between the nozzle and the diameter of the aperture. Preferably, the bottom of the hood 105 should not contact the cover 12 but is sized such that the diameter at the lower edge is sufficiently larger than the diameter of the port 70 so that precipitation or other contaminants do not enter through the port during loading. When filling is completed at one particular location, the filling nozzle is raised and that particular port on the portable hatch cover is closed and one of the other apertures is opened and loading begins again.

Figure 14:
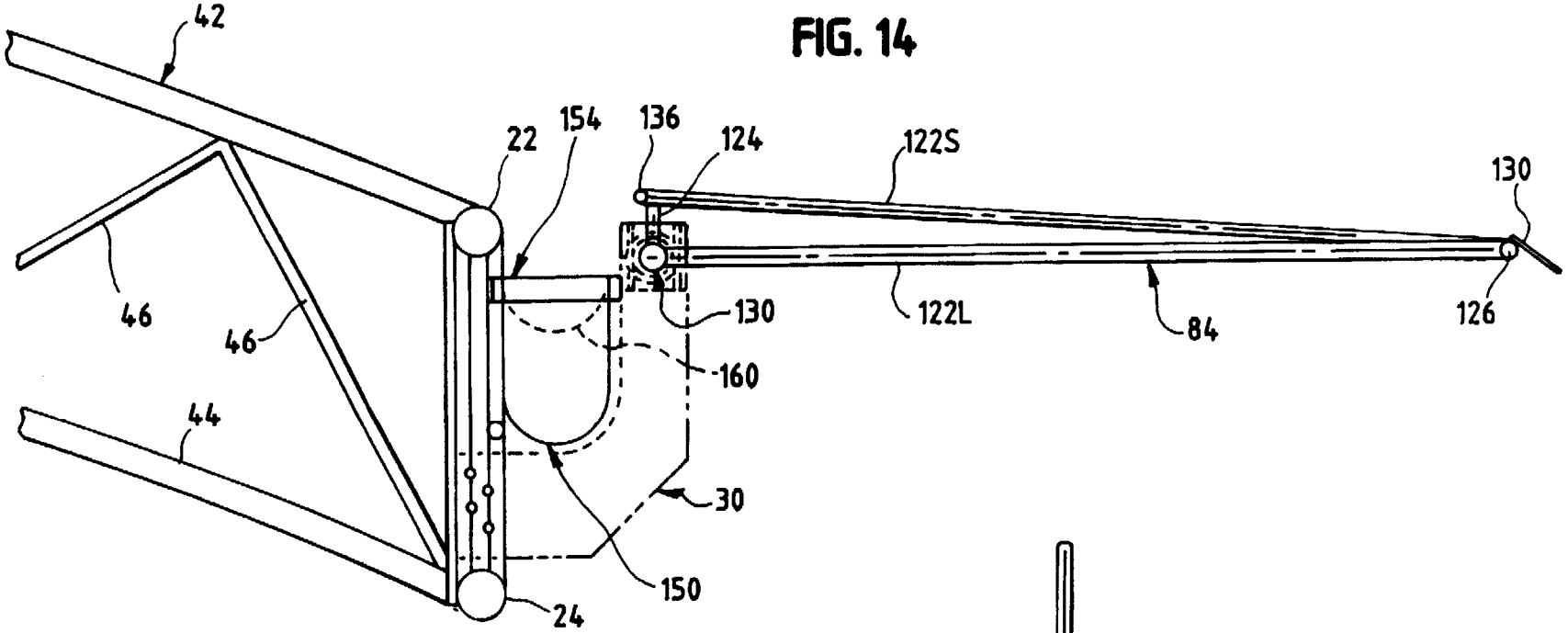
FIG. 14 is a side elevational view of one of the wing elements made in accordance with the present invention.

As described previously, the size of the hatch openings between different ships may vary significantly. Therefore, a pair of outriggers or wings 84 are provided along the longitudinal sides of the hatch cover 10 to accommodate the use of the cover in many situations. The wings 84, as shown in FIG. 14, are generally triangular in shape being formed by two long tubing elements 122L and 122S and very short tubing element 124. The three tubing elements 122L, 122S and 124 are welded together at their ends and the assembly is pivotally mounted at the point where the rods 122L and 124 form a right angle as will be described in greater detail hereinafter. As seen in FIG. 1, the outermost ends of the tubing elements 122 are welded to a longitudinal connecting member 126. A flexible neoprene or rubber flap or cushion 130 is connected to the end of the wing 84 for abutment to the adjacent hatch cover surface on the ship.

As noted above, the wings 84 are supported for pivotal movement on the flanges 30, thereby providing the ability to essentially adjust the width of the hatch cover from 26 feet if the wings were set in a vertical position and an overall width of 38 feet 5½" if the wings 84 are essentially horizontal. The lowermost wing element 122L is substantially larger and more rigid than the upper element 122S and the small vertical elements 124 are welded to a 2⅛" diameter 14 gauge structural tubing member 130 which extends substantially the entire length of the hatch cover. The large tubing member 133 is rotatably supported in the six flanges 30 and permits the wing element to pivot around its axis. The wing element structure, in addition to the tubing elements 122, 124 and 130 include four similarly spaced sets of the three triangular members 122L, 122S and 124 as well as a pair of diagonal or strengthening elements 134 at each end. Preferably, additional strengthening tubing elements 136 which is connected to the inner ends of member 122S for added rigidity and stability. Also, another lengthwise rigidifying tubing element 137 is preferably connected along the entire longitudinal length of the wing. The final assembly of the wings 84 is completed by stretching tightly the sheeting cover portion 10 such as that used in the other elements of the hatch cover.

Figure 7:
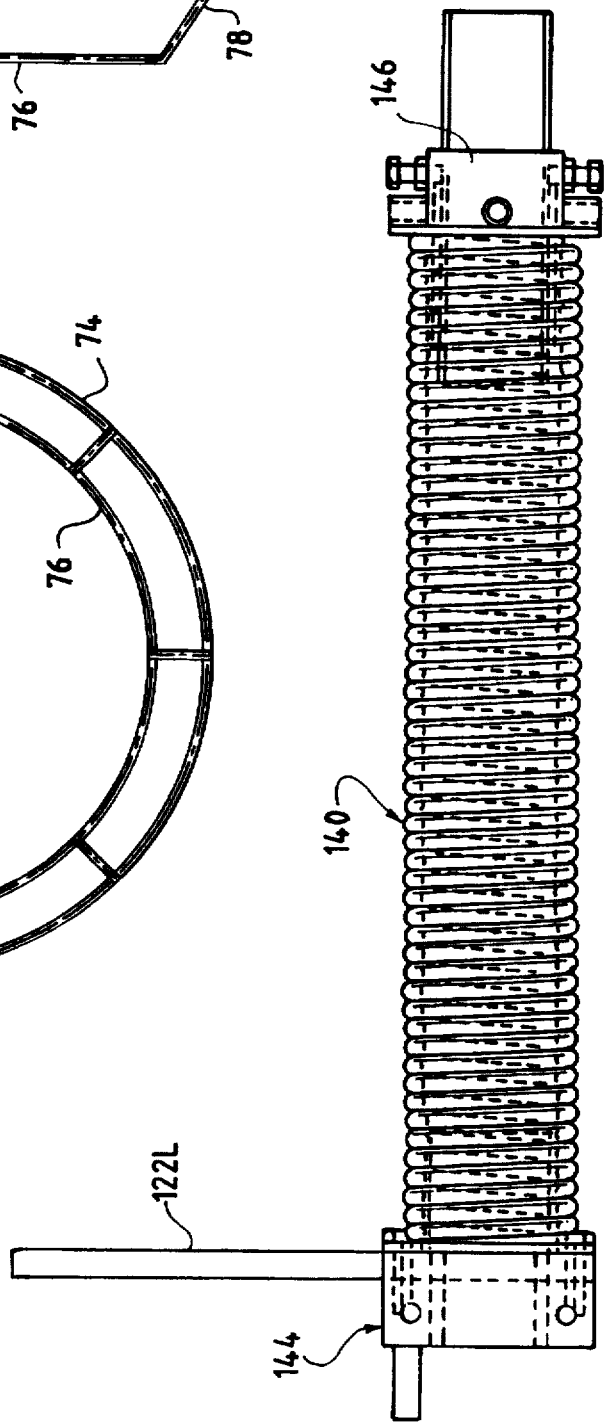
FIG. 7 is an elevational view of a counterbalancing torsion spring assembly.

When the wings are thus covered, the weight is quite substantial and it would be difficult to pivot the wing upwardly and inwardly about the pivot tube 130. Therefore, a counterbalancing torsional spring 140, as shown in FIG. 7, is provided as necessary to counterbalance the weight of the wing assembly.

In the preferred embodiment, six torsional springs on each side were found to be sufficient to facilitate manual movement of the respective wing 84. The wire size of the torsion spring was 0.283" while the coil diameter was 3.75" and the LGT No. 27. The torsional spring 140 was connected in the usual manner to the stationary flange 30 at one end and to one of the rib elements 122L at the other. Alternatively, a right and lefthand spring have been used and similarly connected to the appropriate member. Each spring 140 had a tension adjustment element 146 as is conventionally used to counterbalance home garage doors. It has been found to be advantageous for the spring tension on the innermost springs to be slightly higher than the next adjacent outwardly moving springs so as to provide a slight upward bow in each wing. The upward bowing of the wing and the covering sheet 12 facilitates in proper drainage of rainwater when the portable hatch cover is in use.

In addition to the counterbalancing of the wings as described in the foregoing paragraph, it is also contemplated that means to assist the movement of the wings could be provided in the form of a mechanical, hydraulic, electrical or other system. For example, a conventional mechanical crank could be provided on each wing to facilitate pivotal movement of the wing. Similarly, an hydraulic system could easily be incorporated using one or more hydraulic cylinders to pivot the wings through their entire arcuate path of movement. Likewise, an electric motor could easily be adapted to assist in the movement of the wings. Any of the mechanical, hydraulic or electrical devices could operate each wing selectively or both wings simultaneously and be powered from onboard the vessel, or alternatively, from the dock, as described above with respect to the electromagnetic, holddown system.

Finally, in order to prevent any precipitation from entering the ship hatch between the edge of the main frame section and the inner edge of the respective wing 84, a flexible gutter, generally designated 150, has been provided. The gutter 150 includes a relatively flexible rubber portion, which is connected at its upper ends between two rectangular tubing elements 154 so that any precipitation that would be directed to this area would flow outwardly toward one or the other end of the open hatch. The inner end of the cover portion 12 for each of the wing sections 84 extends inwardly substantially past the innermost tubing element 136 and over the gutter portion 150 so that it will loop into the gutter slightly as shown by the dotted line 160 in FIG. 14 and will vary or move up or down slightly depending upon the relative rotational position of the respective wing 84. In the preferred embodiment, a plurality of apertures are provided for lifting the hatch cover onto the open hatch of a ship. Four apertures are provided, one at each corner of the frame 16 to which cable hooks can be used to grasp and lift the hatch cover.

The foregoing description of the all-weather portable hatch cover of the present invention can be seen to provide a hatch cover capable of protecting cargo when the cargo is being loaded into the open hatch of a ship during inclement or rainy weather. The hatch cover 10 is relatively lightweight and simple in construction but sufficiently rigid and heavy enough so that it is not affected by gusts of wind that may accompany the inclement weather. The main frame section, as described above, is approximately 26 feet in width, but can easily be expanded to 38½ feet by the extra length made possible by the wings 84. Obviously, the wings could be made substantially larger if desired or removed from the hatch cover if they were not needed. In some locations, depending upon the available shipping, it may be desirable to have a number of different sets of wings of different sizes so that they can be removed and replaced with another size, depending upon the size of the hatch cover in the ship to be loaded. The multiple ports permit more even filling, insuring that a full cargo load can be shipped.

It is also contemplated that a suitable dust control system could be added in order to comply with many applicable environmental regulations and/or to reclaim at least a portion of the cargo that may be lost as dust or powder. In particular, it would be possible to mount, for example, a dust collector on the arch trusses or on two adjacent arch trusses of the main frame. The dust collector would be in communication with the underside of the cover through an appropriate aperture and powered to eliminate or remove the dust being generated under the cover during loading. The collected dust could also be delivered, if reclaimed, directly back into the hold of the ship through another aperture in the cover, or evacuated by an appropriate connection off of the ship being loaded.

However, it should be understood that the foregoing, detailed description has been given for clearness of understanding only and no unnecessary limitations should be understood therefrom as many modifications and adaptations would be obvious to those skilled in the art.

We claim:

1. A portable hatch cover for a vessel, comprising:

a generally rectangular main frame section;

a lightweight waterproof cover extending over the frame;

at least one aperture in the cover to permit the passage of fluent cargo through the hatch opening;

at least one cover mountable above the port to permit selective opening and closing of the aperture;

connection means for lifting the portable hatch cover onto the open hatch of a ship to be loaded; and at least one wing pivotally mounted on the frame for adjustment to insure complete closure of the hatch opening.

2. The portable hatch cover of claim 1 wherein the wing is counterbalanced to facilitate manual pivotal movement relative to the frame.

3. The portable hatch cover of claim 2 wherein drive means is provided to move the wings relative to the main frame.

4. The portable hatch cover of claim 3 wherein the drive means includes an electrical motor.

5. The portable hatch cover of claim 3 wherein the drive means includes a mechanical assist.

6. A lightweight hatch cover for covering the open hatch of a ship to permit loading of perishable cargo during inclement weather, comprising:

a generally rectangular frame having an arcuate upwardly extending shape;

a water impervious, stretch-resistant cover extending over the upper surface of the frame;

a plurality of apertures in the top of the cover to permit passage of fluent cargo into the hold of the ship;

a similar plurality of aperture covers movably mounted on the main frame to permit selective opening and closing of the apertures;

at least one outwardly extending wing pivotally mounted to the frame and counterbalanced by at least one torsional spring to facilitate manual rotation of the wing relative to the frame.

* * * * *